US010461414B2

(12) United States Patent
Deng

(10) Patent No.: US 10,461,414 B2
(45) Date of Patent: Oct. 29, 2019

(54) ANTENNA HAVING DIELECTRIC SHEET LOADING TO CONTROL BEAM WIDTH

(71) Applicant: CommScope Technologies LLC, Hickory, NC (US)

(72) Inventor: Gangyi Deng, Allen, TX (US)

(73) Assignee: CommScope Technologies LLC, Hickory, NC (US)

( * ) Notice: Subject to any disclaimer, the term of this patent is extended or adjusted under 35 U.S.C. 154(b) by 219 days.

(21) Appl. No.: 15/516,626

(22) PCT Filed: Nov. 17, 2015

(86) PCT No.: PCT/US2015/061186

§ 371 (c)(1),
(2) Date: Apr. 3, 2017

(87) PCT Pub. No.: WO2016/081515

PCT Pub. Date: May 26, 2016

(65) Prior Publication Data

US 2018/0233815 A1 Aug. 16, 2018

Related U.S. Application Data

(60) Provisional application No. 62/081,226, filed on Nov. 18, 2014.

(51) Int. Cl.
*H01Q 1/42* (2006.01)
*H01Q 1/24* (2006.01)
(Continued)

(52) U.S. Cl.
CPC ..... *H01Q 1/422* (2013.01); *H01Q 1/246* (2013.01); *H01Q 1/42* (2013.01); *H01Q 21/062* (2013.01); *H01Q 25/001* (2013.01); *H01Q 21/26* (2013.01)

(58) Field of Classification Search
CPC ..... H01Q 15/02; H01Q 19/06; H01Q 25/008
See application file for complete search history.

(56) References Cited

U.S. PATENT DOCUMENTS 4,755,820 A 7/1988 Backhouse et al.
8,730,114 B2 * 5/2014 Elliot ..... H01Q 19/06 343/754

(Continued)

FOREIGN PATENT DOCUMENTS

CN 1523708 A 8/2004
CN 202067897 U 12/2011

(Continued)

OTHER PUBLICATIONS

International Search Report and Written Opinion of the International Searching Authority, International Application No. PCT/US2015/061186, dated Mar. 8, 2016.

(Continued)

*Primary Examiner* — Graham P Smith
(74) *Attorney, Agent, or Firm* — Myers Bigel, P.A.

(57) ABSTRACT

A cellular antenna having an array of radiating elements and a flat sheet of dielectric material in front of the antenna radiating elements and spaced about a half wavelength from the antenna phase center to provide an azimuth beam width that is narrower than without the dielectric sheet. The sheet of dielectric material may be continuous or segmented and a single layer or multi-layer. The amount of narrowing may be controlled by changing the thickness and dielectric constant of the dielectric sheet.

20 Claims, 12 Drawing Sheets

(51) Int. Cl.

| | |
|---|---|
| ***H01Q 21/06*** | (2006.01) |
| ***H01Q 25/00*** | (2006.01) |
| *H01Q 21/26* | (2006.01) |

(56) References Cited

U.S. PATENT DOCUMENTS

| | | | |
|---|---|---|---|
| 2005/0062660 | A1 | 3/2005 | Henderson et al. |
| 2012/0032836 | A1 | 2/2012 | Shamim et al. |
| 2014/0111396 | A1 | 4/2014 | Hyjazie et al. |
| 2015/0091767 | A1 | 4/2015 | Matitsine et al. |

FOREIGN PATENT DOCUMENTS

| | | | |
|---|---|---|---|
| CN | 102891373 | A | 1/2013 |
| CN | 202749516 | U | 2/2013 |
| JP | 11340730 | A | 12/1999 |
| WO | WO 2011/031174 | A1 | 3/2011 |
| WO | WO 2013/136325 | A1 | 9/2013 |
| WO | 2014/059946 | A1 | 4/2014 |

OTHER PUBLICATIONS

Volakis, "Antenna Engineering Handbook, Fourth Edition", McGraw-Hill Professional Publishing, New York, NY, USA, 2007, Cover matter, copyright pages, and p. 18-3.

International Preliminary Report on Patentability, International Application No. PCT/US2015/061186, dated Jun. 1, 2017.

Chinese Office Action and Search Report for corresponding Chinese Application No. 201580056133.3, dated Dec. 26, 2018.

* cited by examiner

ANTENNA HAVING DIELECTRIC SHEET LOADING TO CONTROL BEAM WIDTH

CROSS REFERENCE TO RELATED APPLICATIONS

This application is a 35 U.S.C. § 371 national stage application of PCT International Application No. PCT/US2015/061186, filed Nov. 17, 2015, which itself claims priority to the following U.S. Provisional Application pursuant to 35 U.S.C. § 120: U.S. Provisional Application Ser. No. 62/081,226 filed Nov. 18, 2014, the disclosure and content of both of which are incorporated by reference herein in their entireties. The above-referenced PCT International Application was published in the English language as International Publication No. WO 2016/081515 A1 on May 26, 2016.

FIELD OF THE INVENTION

The present invention generally relates to radio communication. More particularly, the invention relates to modifying antenna azimuth beam width for cellular communication systems.

BACKGROUND

For common three sector cellular (tri-cellular) base station applications, each of three tri-sector antennas usually has 65° 3 dB (half power) azimuth beamwidth (AzBW). Such conventional tri-sector antennas may generate a 65° AzBW with a single column of radiating elements.

Six sector base station cells may be employed to increase system capacity. Antennas with 33°-45° AzBW are the most suitable for six sector applications. A traditional way of narrowing AzBW from 65° to 33°-45° involves employing multiple column arrays of radiating elements arranged on a regular flat reflector with horizontal and vertical spacing to achieve a desired AzBW. For example, for a 45° AzBW antenna, two columns of radiating elements may be arranged about one-half wavelength in horizontal spacing. For a 33° AzBW antenna, it is typical to use three columns of radiating elements arranged about one-half wavelength apart in horizontal spacing.

Each additional column of radiating elements adds to antenna width and feed network complexity. The end result is that for AzBW narrower than 65°, the resultant antenna will include a wider reflector than a regular 65° AzBW antenna, with associated increased weight, wind loading and expense. This is disadvantageous for the space on top of the base station tower at each cell site because operators are sharing the space there.

Lensed antennas have been proposed to modify the beamwidth of an antenna. See, Antenna Engineering Handbook, Fourth Edition, 2007 McGraw-Hill Companies, p. 18-3. The main drawback of this type of antenna is that it requires a large lens with different shapes, which is not acceptable for mounting this type of antenna on the top of the tower with limited space. Additionally, manufacturing this shape of lens may be prohibitively expensive. Another proposed solution is U.S. Pat. No. 4,755,820. In this patent, dielectric loading involves a hemisphere lens, which covers the top half of the antenna. The size of the hemisphere sheet is undesirably large.

Consequently, there is a need to provide a narrower AzBW in a small envelope due to the space limitation on top of the tower, without a large, expensive lens.

SUMMARY

A cellular antenna assembly may comprise an array of radiating elements and a flat sheet of dielectric substrate material loading in front of the antenna/base station antenna, and spaced about half wavelength in distance from the antenna phase center. The azimuth beam width of the antenna with the flat dielectric sheet is narrower than without the dielectric sheet. For example, using a conventional 65° AzBW antenna with a flat dielectric sheet may reduce AzBW to between 45° to 33°, all without appreciably changing the width or aperture of the antenna.

The amount of narrowing of beamwidth may be controlled by changing the thickness and dielectric constant of the dielectric sheet. This provides the possibility of optimizing the wireless communication network with different horizontal azimuth beam width antenna. Another advantage of the flat sheet of dielectric is that it is relatively inexpensive, easier to manufacture, and lighter in weight than known antenna lenses.

DESCRIPTION OF EXAMPLES OF THE INVENTION

The present invention is described herein with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Many different embodiments are disclosed herein, in connection with the description and the drawings. It will be understood that it would be unduly repetitious and obfuscating to literally describe and illustrate every combination and subcombination of these embodiments. Accordingly, the present specification, including the drawings, shall be construed to constitute a complete written description of all combinations and subcombinations of the embodiments described herein, and of the manner and process of making and using them, and shall support claims to any such combination or subcombination.

Figure 1A:
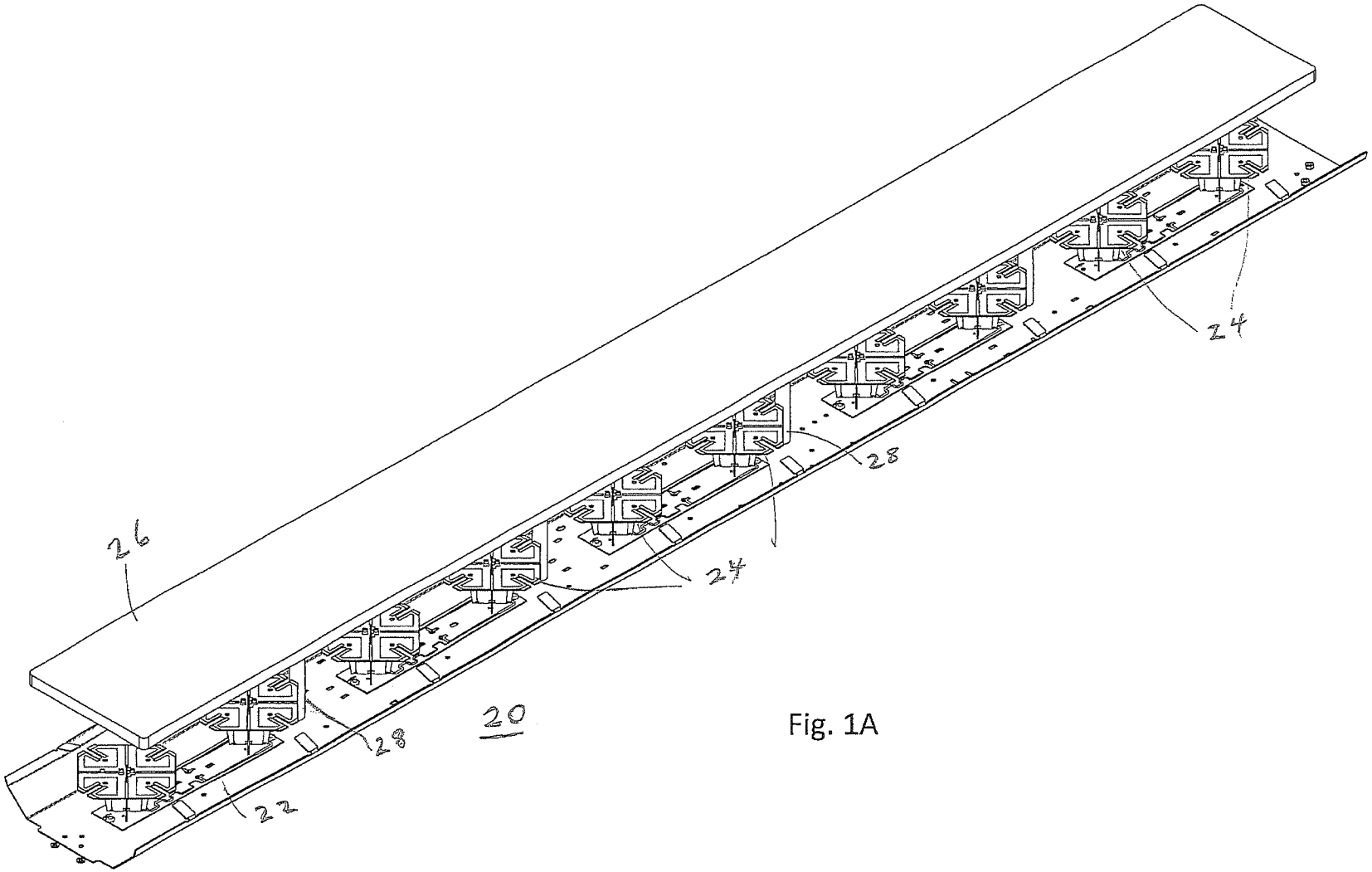
FIG. 1A is a cellular communications antenna according to one aspect of the present invention.
Figure 1B:
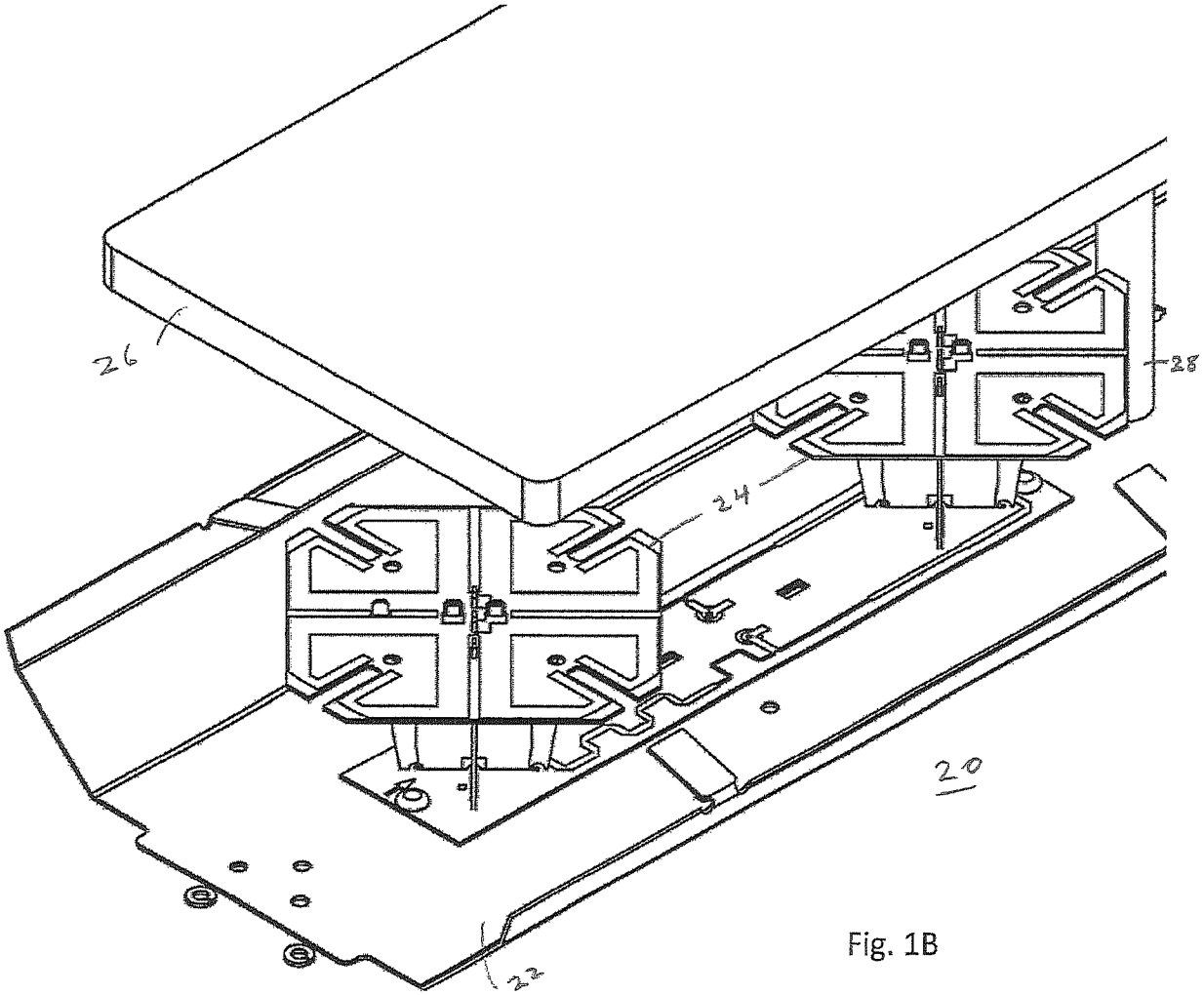
FIG. 1B is an enlarged view of a portion of the communications antenna of FIG. 1.

Referring to FIGS. 1A and 1B, an antenna 20 according to one aspect of the present invention is illustrated. The antenna comprises a reflector 22, a phased array of radiating elements 24 in a column, a dielectric sheet 26, and a plurality of stand-offs 28 connected to the reflector 22 and the dielectric sheet 26 of substantially uniform thickness. The stand-offs 28 position the dielectric sheet above the radiating elements 24, as shown. The dielectric sheet 26 in FIG. 1A may comprise a substantially flat, continuous sheet of substantially uniform thickness running the length of the antenna. The width, in one example, is 120 mm which extends over at least the majority of the width of the radiating elements. In some preferred embodiments the dielectric sheet may be from 3 mm to 15 mm thick and have a dielectric constant in the range of 3 to 15.

The radiating elements 24 may be, as illustrated, cross polarized dipole radiating elements 24. Other types of radiating elements may also be acceptable. The radiating elements 24 will have a nominal operating frequency at about the mid-point between the highest and lowest operating frequencies of the radiating elements 24. In one aspect of the invention, the dielectric sheet 26 is substantially flat, as shown, and is positioned by the stand-offs 28 to be about one-half wavelength above the phase center of the radiating elements 24 at the nominal operating frequency. In one embodiment the dielectric sheet is positioned between 0.4 and 0.6 wavelength above the radiating elements. The thickness and dielectric constant of the dielectric sheet 26 may be selected to achieve a desired AzBW. In some embodiments the thickness may range from about 2 mm to 25 mm, with a dielectric constant of 2 or greater.

Figure 2:
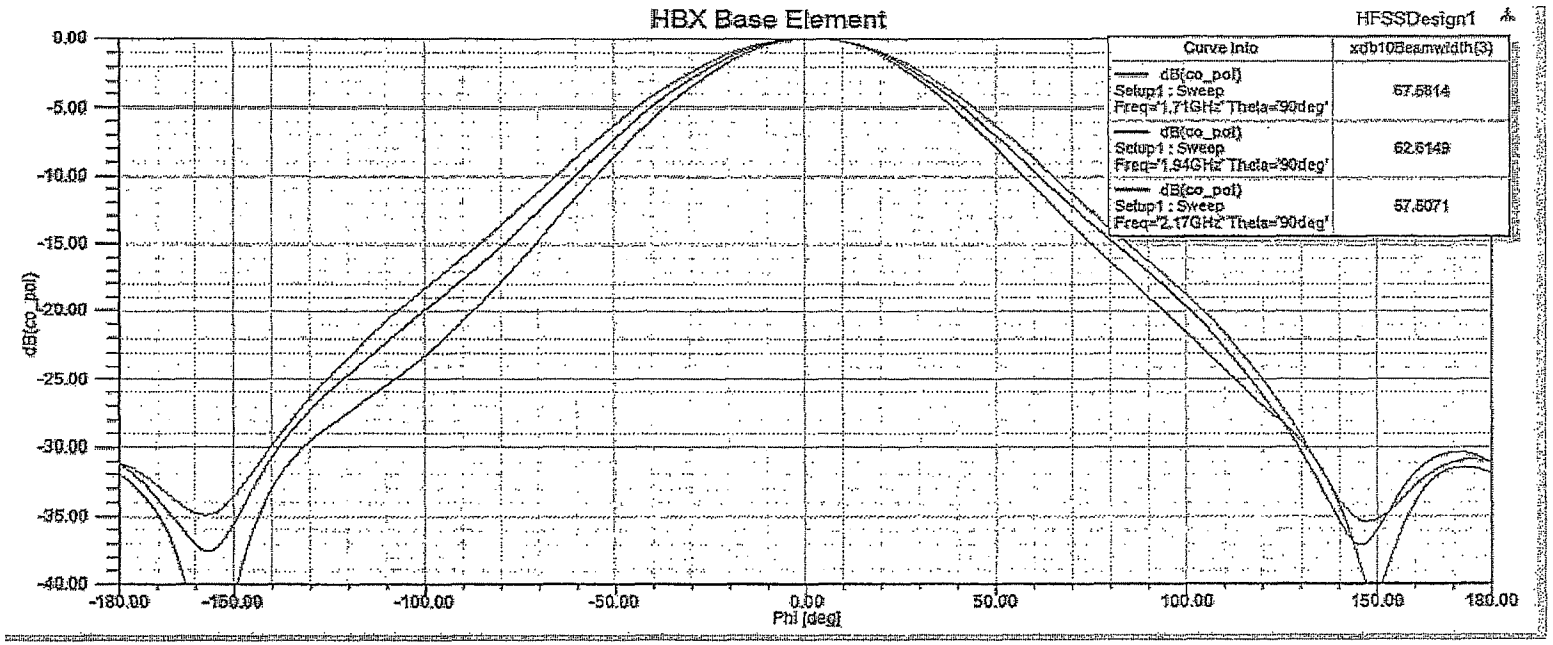
FIG. 2 is a simulation of the radiation pattern of a single radiating element from a 65° AzBW antenna.

For example, FIG. 2 illustrates a simulated radiation pattern for a single cross polarized element 24. The element without any dielectric sheet has an AzBW of 62.6° at 1.94 GHz.

Figure 3:
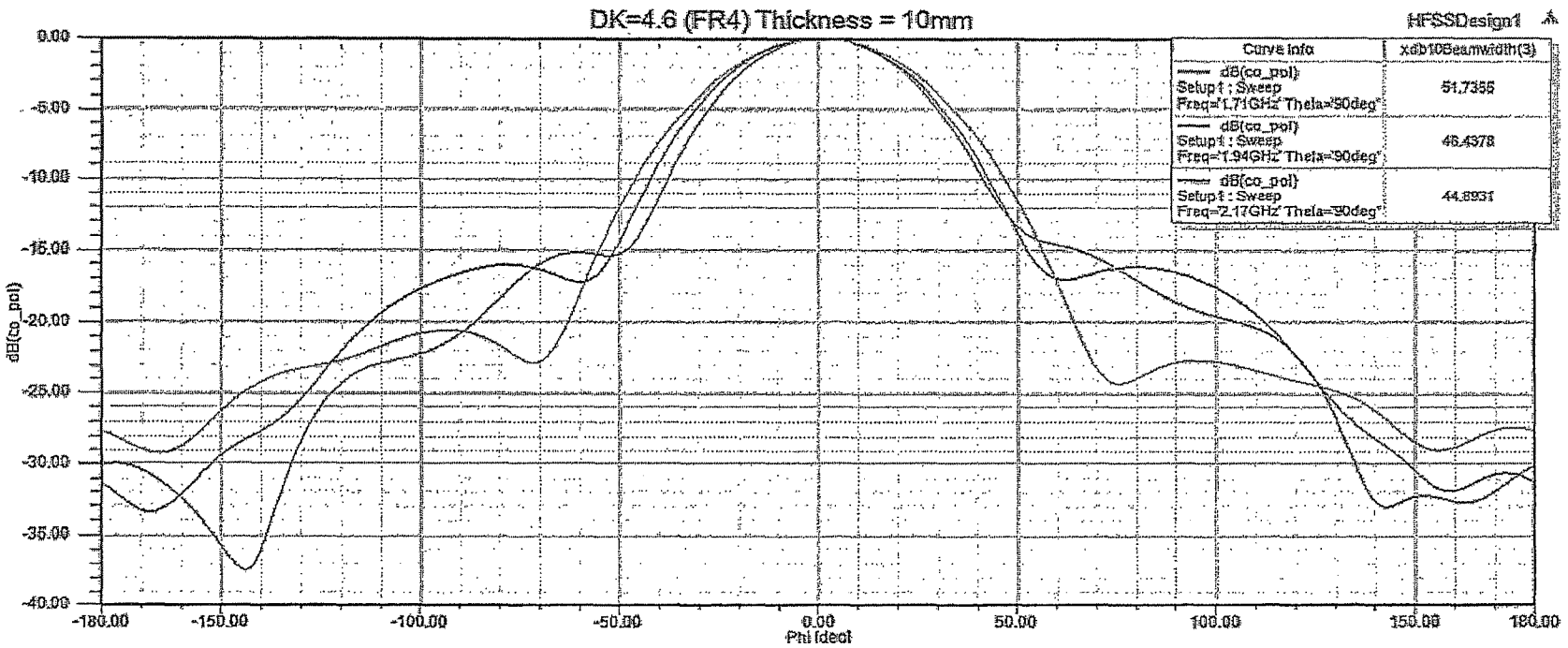
FIG. 3 is a simulation of the radiation pattern of a single radiating element and an exemplary sheet of dielectric according to one example of the invention.

FIG. 3 is an illustration of a simulation of a radiation pattern for the same cross polarized element 24 with a dielectric sheet 26 spaced above the radiating element. In this example, the material is FR4, having a dielectric constant of 4.6. The sheet is 10 mm thick, and is spaced 77.5 mm from the radiating element, which is a little less than one-half wavelength. At 1.94 GHz, the AzBW is 48.5°.

Figure 4:
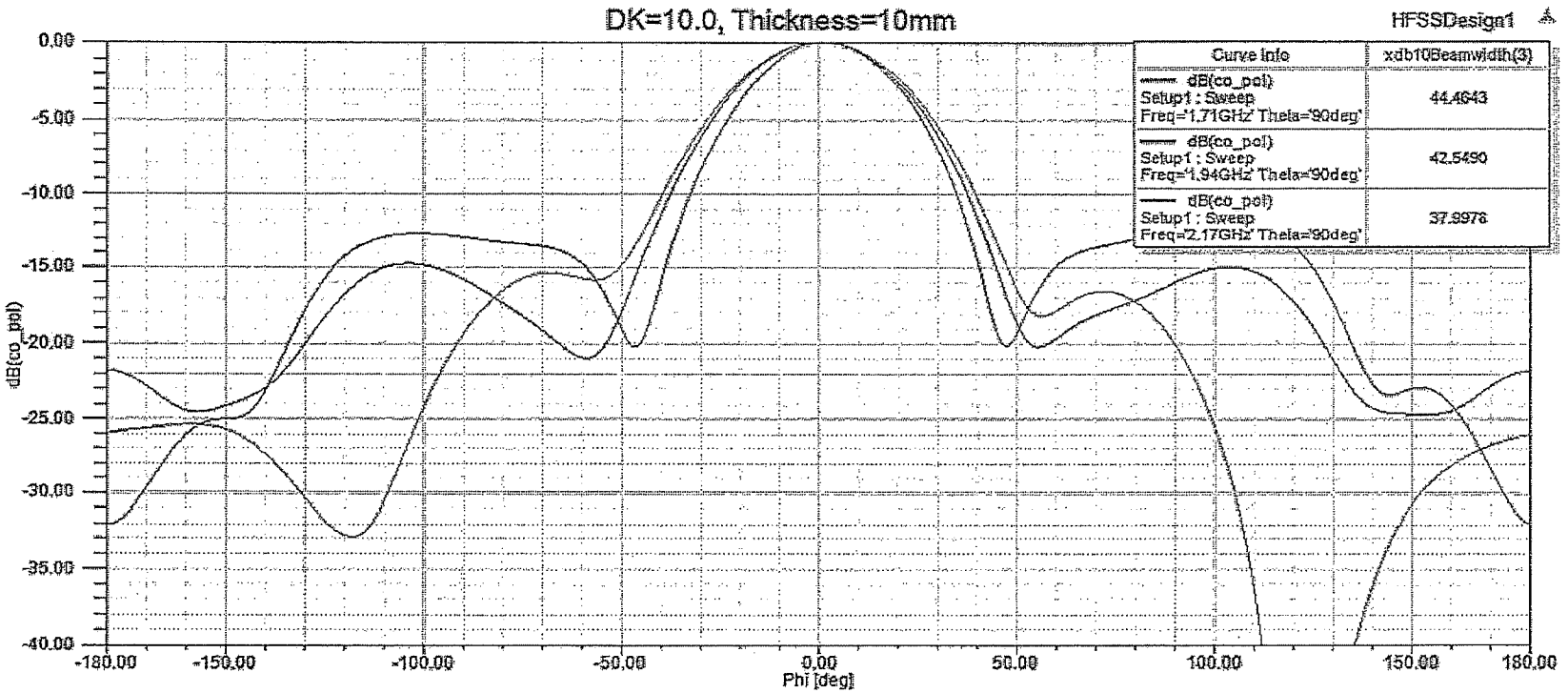
FIG. 4 is a simulation of the radiation pattern of a single radiating element and an exemplary sheet of dielectric according to a second example of the invention.

FIG. 4 is an illustration of a simulation of a radiation pattern for the cross polarized element 24 with a second example of a dielectric sheet 26. In this example, the material is TMM10, which may be obtained from Rogers Corp. The dielectric constant of this material is 10. The thickness remains at 10 mm thick, and the spacing remains at 77.5 mm from the radiating element 24. At 1.94 GHz, the AzBW is 42.5°.

Figure 5:
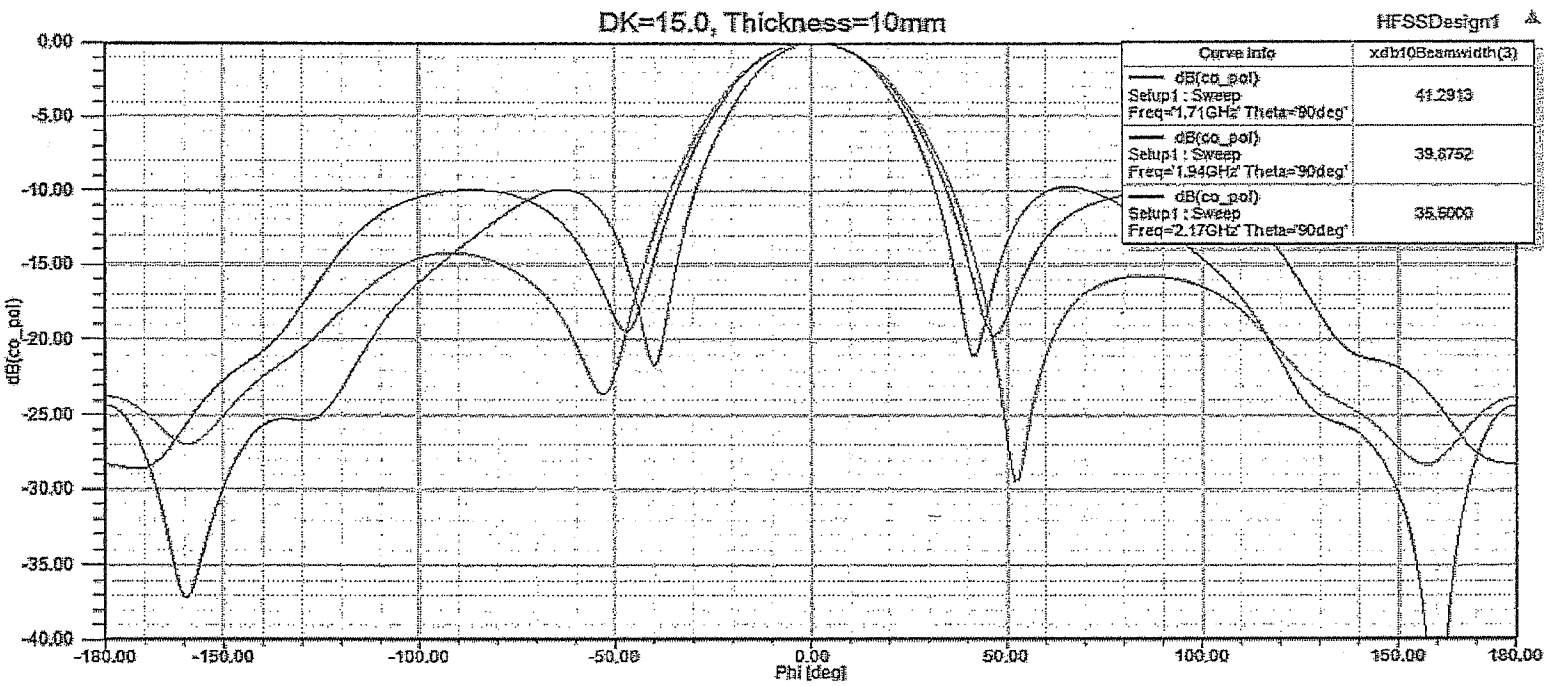
FIG. 5 is a simulation of the radiation pattern of a single radiating element and an exemplary sheet of dielectric according to a third example of the invention.

FIG. 5 is an illustration of a simulation of a radiation pattern for the cross polarized element 24 with a third example of a dielectric sheet 26. In this example, the dielectric constant is 15. The thickness remains at 10 mm thick, and the spacing remains at 77.5 mm from the radiating element. At 1.94 GHz, the AzBW is 39.8°.

Figure 6:
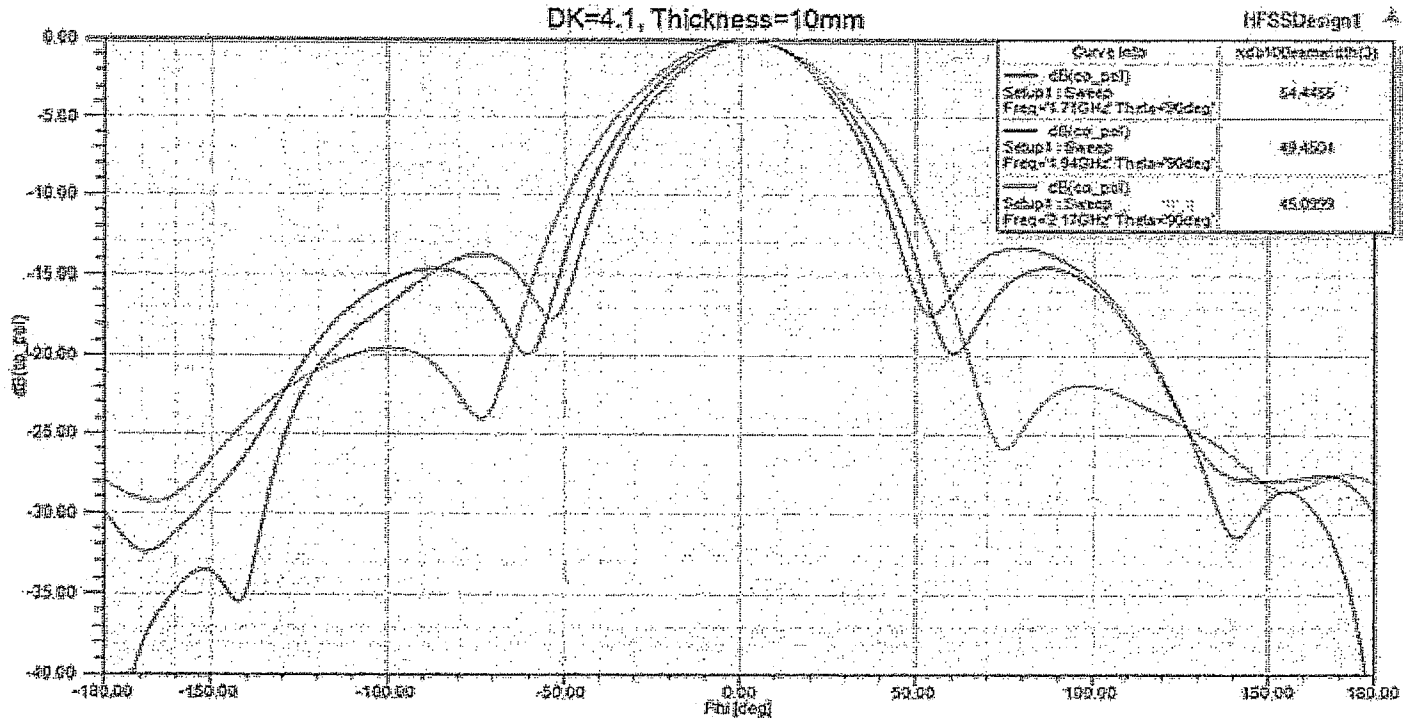
FIG. 6 is a simulation of the radiation pattern of a single radiating element and an exemplary sheet of dielectric according to a fourth example of the invention.

FIG. 6 is an illustration of a simulation of a radiation pattern for the cross polarized element 24 with a fourth example of a dielectric sheet 26. In this example, the material is glass reinforced polyester, and the dielectric constant is 4.1. The thickness is 9.5 mm thick, and the spacing remains at 77.5 mm from the radiating element. At 1.94 GHz, the AzBW is 49.45°.

Figure 7:
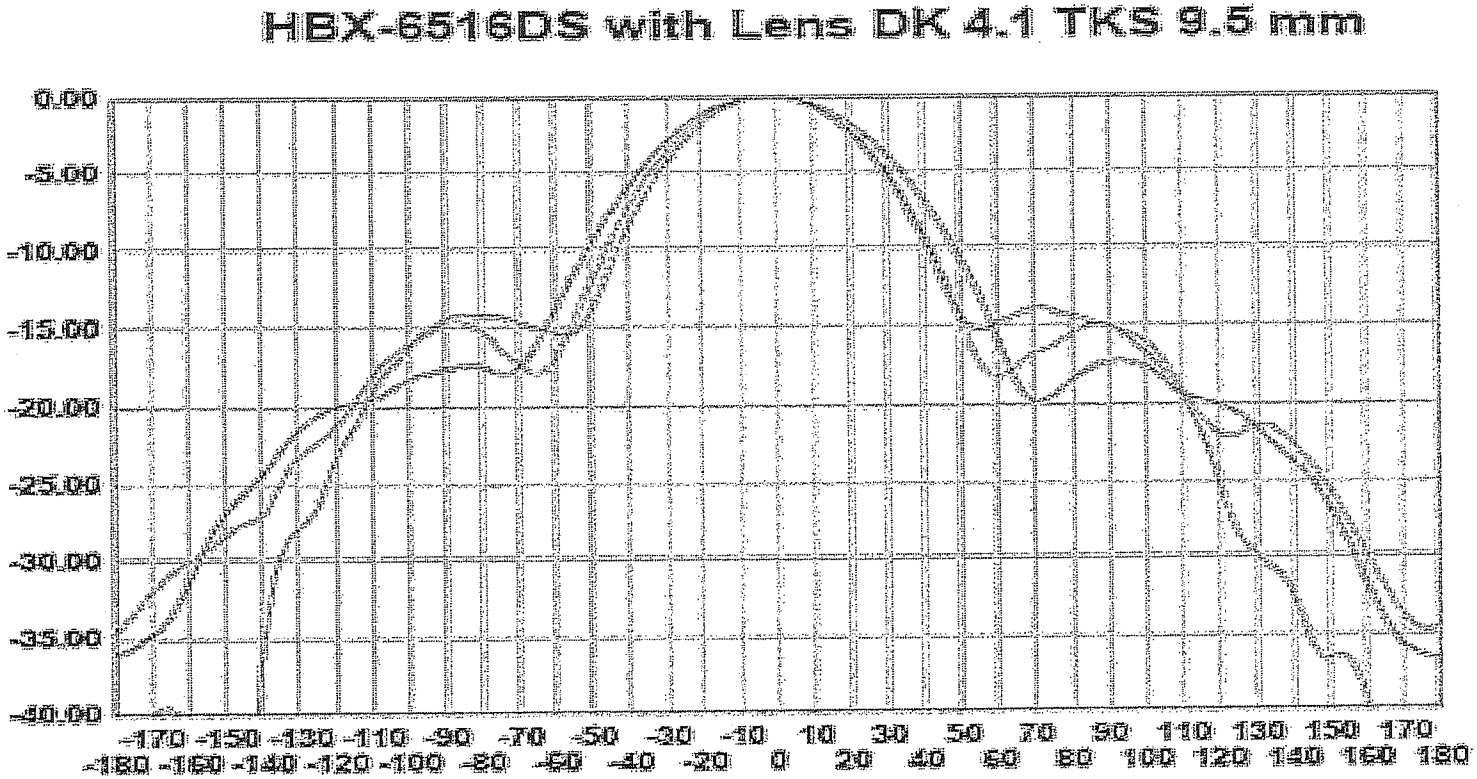
FIG. 7 is a measured radiation pattern of an antenna according to one example of the invention.

FIG. 7 illustrates actual experimental results from an antenna configured as illustrated in FIGS. 1A and 1B, with the exemplary dielectric material of FIG. 6. In this example, the antenna 20 is based on a conventional CommScope HBX-6516DS antenna, which is a 65° High Band cross polarized antenna. A dielectric sheet 26 is added to the antenna 20 as simulated in FIG. 6. In particular, the dielectric sheet has a dielectric constant of 4.1 and a thickness of 9.5 mm. The sheet is spaced 77.5 mm from the radiating elements. The results are an AzBW of 56° at 1.71 GHz, 51° at 1.94 GHz, and 48° at 2.17 GHz. The baseline results for a standard HBX-6516DS antenna are 69° at 1.71 GHz, 64° at 1.94 GHz, and 61° at 2.17 GHz. The observed narrowing of AzBW is in line with the simulations.

It is not necessary to use the stand-offs 28 to position the dielectric sheet 26. For example, in one alternate embodiment, the dielectric sheet 26 may be attached to and positioned by a radome. In another example, the radome may be designed with the teachings of this invention and integrate the beam narrowing structure into the radome itself.

Figure 8:
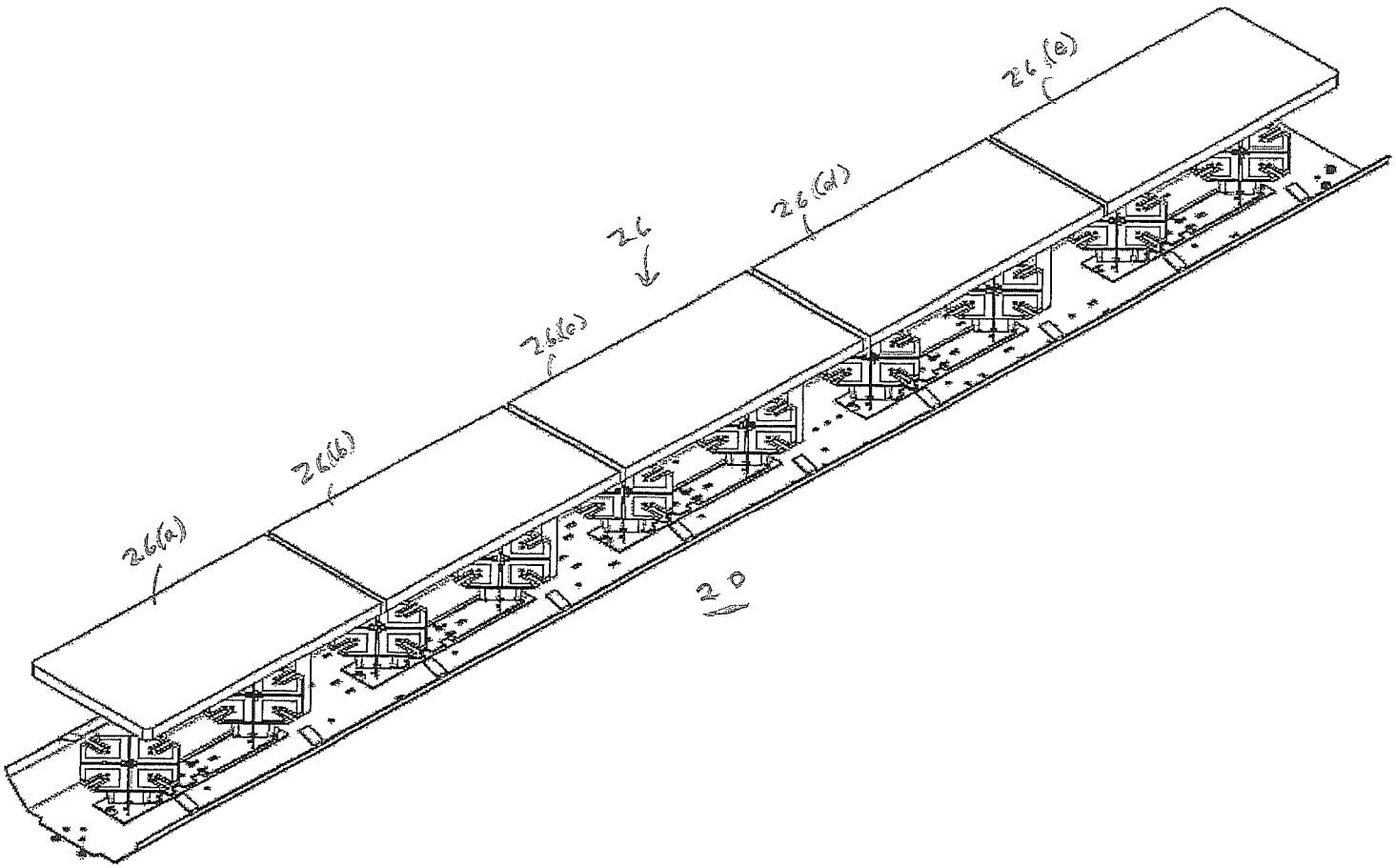
FIG. 8 is a cellular communications antenna according to another aspect of the present invention.

An alternative embodiment of the dielectric sheet 26 is illustrated in FIG. 8. In this example, the dielectric sheet 26 is comprised of a plurality of shorter dielectric sheet sections 26(*a*), 26(*b*), 26(*c*), 26(*d*), 26(*e*) which do not run the length of the antenna. Manufacturing the dielectric sheet 26 in sections as illustrated in FIG. 8 may improve manufacturability, provide for modularity of the design, and reduce manufacturing costs. The shape of the dielectric sheet 26 may also vary, for example, the dielectric sheet may be in the shape of a circle, an octagon, or other geometric shape.

Figure 9:
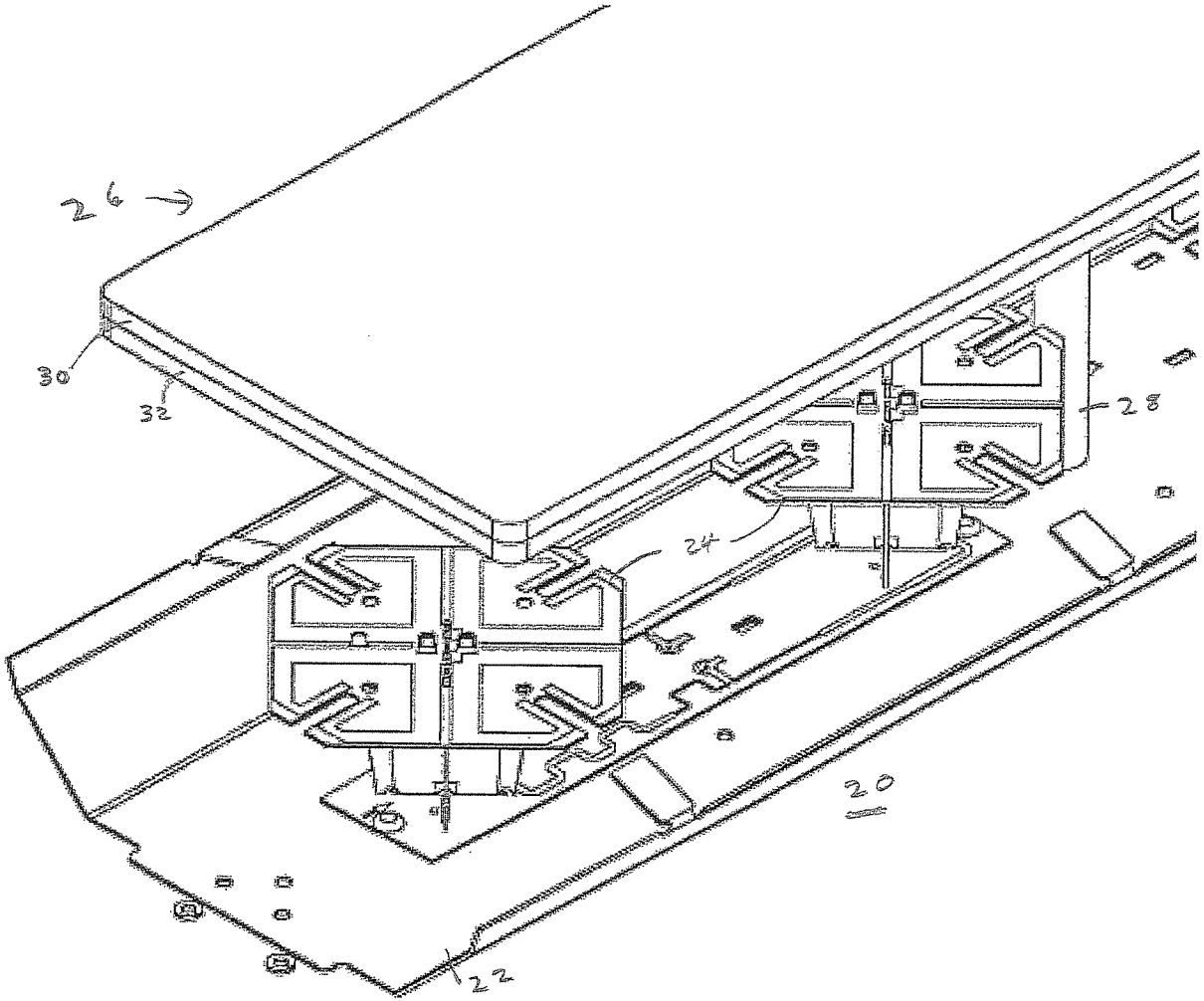
FIG. 9 is a cellular communications antenna according to another aspect of the present invention.

Referring to FIG. 9, another alternative embodiment of the dielectric sheet 26 is illustrated. In this example, the dielectric sheet 26 comprises a plurality of layers 30, 32 of dielectric material. Building the dielectric sheet 26 from layers allows for customization of beam patterns. For example, if the dielectric sheet is 5 mm thick, assembling a given antenna with one, two or three layers would provide a dielectric sheet of 5, 10, and 15 mm, respectively. In this case, the AzBW would progressively become more narrow as layers are added to the dielectric sheet.

The alternative embodiments disclosed in FIGS. 8 and 9 are not mutually exclusive. Segmented dielectric sheets may also be manufactured with layers.

Figure 10:
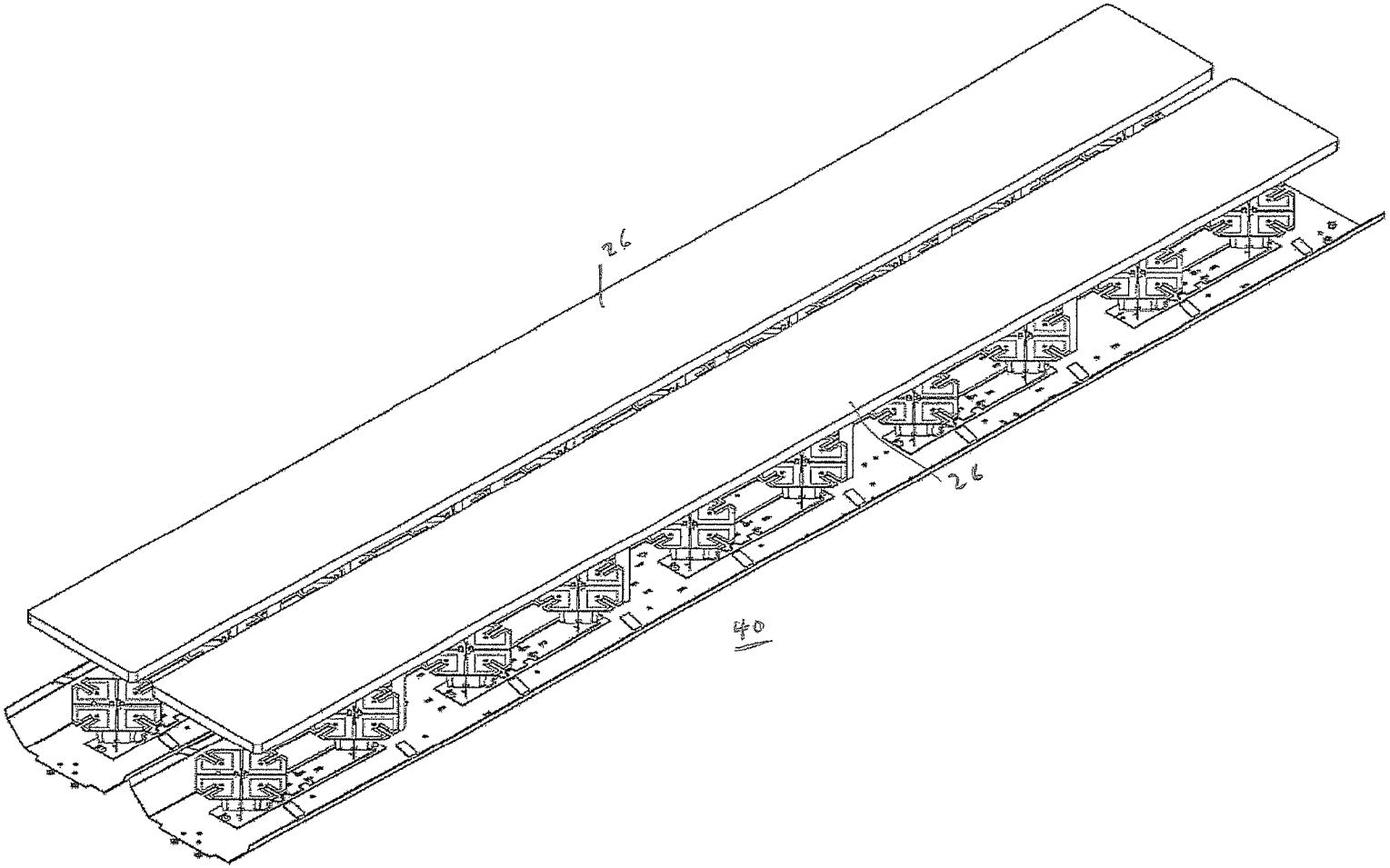
FIG. 10 is a cellular communications antenna having two arrays according to another aspect of the present invention.

Referring to FIG. 10, a dual-array antenna 40 is illustrated. In the illustrated example of FIG. 10, each array comprises an antenna array as illustrated in FIGS. 1A and 1B. A dual-array antenna 40 allows for further control of AzBW. The dielectric sheet 26 may be unitary, sectioned, and/or segmented as described above. This technology can also be applied to multiple array antennas.

Figure 11:
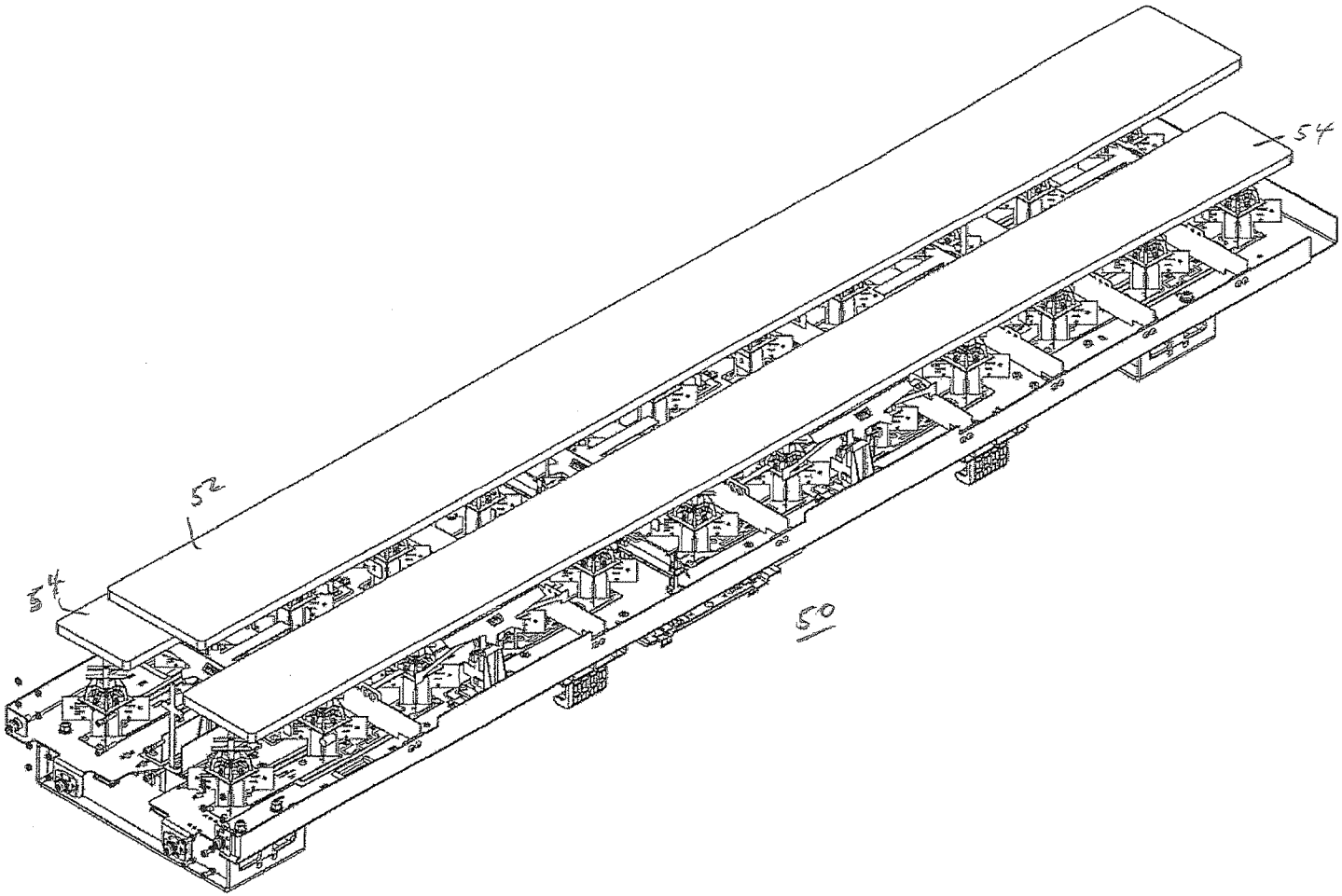
FIG. 11 is a multi-band cellular communications antenna according to another aspect of the present invention.

The present invention may be extended to dual band or multi-band antennas. However, since wavelength is inversely proportional to frequency, the height of the radiating element 24 from the reflector 22, and the spacing of the dielectric sheet 26 from the radiating element 24, will be different for different frequency bands. Referring to FIG. 11, for each array of radiators in a different frequency band, a dielectric sheet 26 may be placed at an appropriate (one-half wavelength) height from its respective radiating element, as shown. In the example of FIG. 11, the antenna 50 comprises a low frequency band (e.g. 698-896 MHz) column of radiating elements with a low band dielectric sheet 52 and two columns of high frequency band radiating elements, each high band column also having a high band dielectric sheet 54. The low band dielectric sheet 52 is spaced one-half low band wavelength from the low band radiating elements, and the high band sheets 54 are spaced about one half high band wavelength from the high band radiating elements.

Although embodiments of the present invention have been described with reference to specific example embodiments, it will be evident that various modifications and changes may be made to these embodiments without departing from the broader spirit and scope of the invention. Accordingly, the specification and drawings are to be regarded in an illustrative rather than a restrictive sense and it is intended that the invention be limited only to the extent required by the appended claims and the applicable rules of law.

The Abstract of the Disclosure is provided to comply with 37 C.F.R. § 1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter may lie in less than all features of a single disclosed embodiment. Thus, the following claims are hereby incorporated into the Detailed Description, with each claim standing on its own as a separate embodiment.

What is claimed is:

1. An antenna for a wireless communication system comprising:

a columnar array of dipole radiating elements; and a substantially flat sheet of dielectric material, wherein the sheet of dielectric material is positioned over the columnar array of dipole radiating elements and spaced at a predetermined distance from the dipole radiating elements, and wherein the sheet of dielectric material extends over at least a majority portion of the array of dipole radiating elements, and wherein the sheet of dielectric material narrows an azimuth beam width of a beam formed by the array of dipole radiating elements; and a radome that covers the array of dipole radiating elements.

2. The antenna of claim 1 further comprising a reflector.

3. The antenna of claim 2 further comprising a plurality of stand-offs connected to the reflector and to the sheet of dielectric material which position the sheet of dielectric material at the predetermined distance above the array of dipole radiating elements.

4. The antenna of claim 1 wherein the predetermined distance is about a half wavelength above a phase center of the dipole radiating elements at a nominal operating frequency of the dipole radiating elements.

5. The antenna of claim 1 wherein the sheet of dielectric material is a continuous sheet.

6. The antenna of claim 1 wherein the sheet of dielectric material comprises a plurality of segments of dielectric material.

7. The antenna of claim 1 wherein the sheet of dielectric material is attached to the radome.

8. The antenna of claim 7 wherein the sheet of dielectric material is integrated into the radome.

9. The antenna of claim 1 wherein the sheet of dielectric material is non-rectangular in shape.

10. The antenna of claim 1 wherein the sheet of dielectric material comprises a plurality of layers of dielectric material.

11. The antenna of claim 1, wherein the array of dipole radiating elements is a first array of dipole radiating elements, wherein the sheet of dielectric material is a first sheet of dielectric material, and wherein the antenna further comprises a second array of dipole radiating elements and a second sheet of dielectric material positioned over the second array of dipole radiating elements.

12. The antenna of claim 1 wherein the antenna is a multi-band antenna comprising a plurality of arrays of dipole radiating elements, each respective array having a respective sheet of dielectric material positioned over the respective array at a distance of about a half wavelength of a nominal operating frequency of the respective array.

13. The antenna of claim 1 wherein the dipole radiating elements are cross-polarized.

14. The antenna of claim 1 wherein the sheet of dielectric material has a thickness between about 3 mm and about 15 mm.

15. The antenna of claim 1 wherein the sheet of dielectric material has a dielectric constant between about 3 and about 15.

16. The antenna of claim 1 wherein the sheet of dielectric material is glass reinforced polyester.

17. The antenna of claim 6 wherein the segments of dielectric material are non-rectangular in shape.

18. An antenna comprising:

an array of low-band dipole radiating elements;

an array of high-band dipole radiating elements; and first and second sheets of dielectric material, wherein the first sheet of dielectric material is positioned over the array of low-band dipole radiating elements, wherein the second sheet of dielectric material is positioned over the array of high-band dipole radiating elements, and wherein the first sheet is positioned from the array of low-band dipole radiating elements at a first distance and the second sheet is positioned from the array of high-band dipole radiating elements at a second distance that is different from the first distance, and wherein the first and second sheets of dielectric material narrow azimuth beam widths of beams formed by the low-band array of dipole radiating elements and high-band array of dipole radiating elements, respectively.

19. The antenna of claim 18, wherein the first and second sheets of dielectric material extend over at least a majority portion of the low-band array of dipole radiating elements and high-band array of dipole radiating elements, respectively.

20. A method comprising:

positioning a sheet of substantially flat dielectric material over an array of dipole radiating elements, wherein the sheet of substantially flat dielectric material is positioned over the array of dipole radiating elements at a first predetermined distance that is based on a nominal operating frequency of the dipole radiating elements, and wherein the sheet of substantially flat dielectric material is dimensioned such that an azimuth beam width of a beam formed by the array of dipole radiating elements is narrowed by the sheet of substantially flat dielectric material.

* * * * *